US005345912A

United States Patent [19]

Svensson et al.

[11] Patent Number: 5,345,912

[45] Date of Patent: Sep. 13, 1994

[54] METHOD AND DEVICE FOR CONTROLLING A CARBURETOR

[75] Inventors: Ulf Svensson, Trollhättan; Hans Ström, Kode, both of Sweden

[73] Assignee: Aktiebolaget Electrolux, Sweden

[21] Appl. No.: 20,153

[22] Filed: Feb. 19, 1993

[30] Foreign Application Priority Data

Feb. 20, 1992 [SE] Sweden ..... 9200523-0

[51] Int. Cl.[5] ..... F02M 7/00

[52] U.S. Cl. ..... 123/438; 123/491

[58] Field of Search ..... 123/438, 441, 491

[56] References Cited

U.S. PATENT DOCUMENTS

| | | | |
|---|---|---|---|
| 4,436,073 | 3/1984 | Miyagi | 123/491 |
| 4,524,742 | 6/1985 | Bonfigliogli et al. | 123/438 |
| 4,685,434 | 8/1987 | Ando et al. | 123/438 |
| 4,787,356 | 11/1988 | Rosgen et al. | 123/438 |

*Primary Examiner*—Raymond A. Nelli

*Attorney, Agent, or Firm*—Pearne, Gordon, McCoy & Granger

[57] ABSTRACT

In a method and device for controlling a carburetor (1) of an i. c. engine, the A/F ratio thereof is automatically adjusted to a preferred level during varying operating conditions. An adjusting means (5) is continuously actuated by a first control unit (4) of a first control circuit (3) to provide a A/F ratio having a modified dependency on the speed of rotation. An adjusting means (9) is periodically actuated for a short period by a second control unit (7) of a second control circuit (6), said second control unit receiving speed information (8) from the engine (2), to provide a short-term change of the mixture ratio, and the change of speed of rotation caused thereby is measured. With regard to the obtained result and stored information the second control unit (7) performs an adjustment of the mixture ratio by a predetermined step towards leaner or richer mixture by actuating an adjusting means (5). This procedure is repeated in the second control circuit (6) until the change of speed of rotation indicates that the mixture ratio is at a preferred level, and this adjustment is maintained for a period of time.

8 Claims, 3 Drawing Sheets

METHOD AND DEVICE FOR CONTROLLING A CARBURETOR

BACKGROUND OF THE INVENTION

The present invention relates to a method and a device for controlling a carburetor of an internal combustion (i. c.) engine in order to automatically adjust the mixture or air/fuel ratio thereof to a preferred level at different operational conditions.

In all i. c. engines the so-called air/fuel ratio is of great importance to the function of the engine. The air/fuel ratio is usually designated A/F. To obtain a proper combination of low fuel consumption, low exhaust gas emissions, good operability, and high power the A/F ratio must be kept within relatively close limits; cf. FIG. 3. As a rule, an A/F ratio slightly to the lean side of the optimal power value is preferred.

Future legal restrictions on emissions of CO will not allow manual adjustment of the carburetor. With the tolerances of manufacture of the carburetor that can be obtained it is not possible by using fixed nozzles in the carburetor to both fulfil the mentioned legal restrictions and simultaneously assure the operator a good operability at all combinations of air pressure, temperature, varying fuel quality, etc. The preferred A/F ratio is namely influenced by a number of factors. Some of these are known when the engine is designed and can therefore be corrected from the beginning, but others depend on variations of external circumstances such as air pressure, temperature, and fuel quality, and variations connected with the manufacture of the carburetor.

Theoretically it would perhaps be possible to calibrate each carburetor and use sensors for pressure, temperature, fuel quality, etc. but in practice this would be very expensive and the system would be complicated and have a low reliability of operation. As a consequence, certain i. c. engines are provided with special oxygen sensors or lambda sonds in the exhaust system. It is thereby possible to sense the performance of the combustion and the result of the measurements of the sond can be used in a control system to control the A/F ratio in order to provide a good result. The result of the oxygen sensor (lambda sond) is fed back to the fuel control system, whereby no further sensors are required. However, this is an expensive and complicated control system which for reasons of cost and operational reliability can hardly be used in such consumer products as motor saws, lawn mowers, etc.

The object of the invention is to reduce the above-mentioned problems essentially by providing a method and a device for controlling a carburetor of an i. c. engine by which the A/F ratio is automatically adjusted to a preferred level at different operational conditions without using an oxygen sensor (lambda sond). This object is obtained by a method and a device which according to the invention are characterized by the features set forth in the accompanying claims.

SUMMARY OF THE INVENTION

The method according to the invention is generally characterized by the steps of generally continuously actuating an adjustment means by a first control unit of a first control circuit to adjust the A/F ratio with regard to a previously known speed dependency of the mixture ratio to provide a modified speed dependency thereof. Periodically actuating an adjusting means for a short term by a second control unit of a second control circuit, the second control unit receiving speed information from the engine to provide a short term change of the A/F ratio. Measuring the change of speed of rotation caused thereby, to determine, with regard to the obtained result and stored information, whether the A/F ratio is a leaner or richer mixture compared to a preferred level. Adjusting the A/F ratio ratio by a predetermined step towards the preferred level by actuating an adjusting means. Repeating said procedure in said second control circuit until the change of speed of rotation indicates that the mixture ratio is at the preferred level, and maintaining said adjustment for a period of time after which said second control circuit reassumes the adjustment of the mixture ratio.

This means that the first control circuit adjusts the engine speed dependency on the A/F ratio on the basis of previously known information thereof. The second control circuit performs periodical tests in which an adjusting means is shortly actuated so that the A/F ratio is changed shortly. The change of the speed of the engine caused thereby is analysed in the control unit and provides a small change of the A/F ratio in the preferred direction, and this procedure is repeated in the second control circuit until a preferred result is obtained.

In analysing the change of engine speed, knowledge is used of the response of the engine regarding the speed thereof to variations of the A/F ratio. By using this knowledge it is thus possible, by a number of test changes with subsequent corrections, to obtain a preferred state of operation. As the second control circuit has an engine speed feed-back connection, it can compensate for almost any type of deviation that may occur during operation of the engine. This means that the same advantages are obtained as in a control system provided with an oxygen sensor (lambda sond) having a feed-back connection, and according to the invention this is obtained at lower cost and higher operational reliability.

Some form of measuring of the engine speed is already inherent in all ignition systems. The engine speed measuring system can use the pulses already available in the ignition system which results in a low cost and high reliability. Normally, the first control unit adjusts the mixture ratio so as to remain generally constant at differing engine speed. The amount of this adjustment is kept as small as possible in order not to reduce the scope of adjustment of the second control circuit. The second control circuit differs from the first one in that it has a feed-back connection whereby generally all variations can be taken into account.

In a preferred embodiment of the invention, the first control unit actuates a pump which in turn actuates the air pressure in the air chamber of the carburetor and consequently actuates the amount of injection of fuel to the carburetor and thus the A/F ratio A/F. The second control unit periodically adjusts the A/F ratio. Initially, a test adjusting means is actuated whereby the mixture ratio is shortly made leaner. In this case the adjusting means is a fuel needle which closes or opens a secondary flow to the main nozzle of the carburetor. The change of engine speed occuring during the short change of the A/F ratio to a leaner value is fed to the second control unit. On the basis of information stored in the memory thereof and the change of engine speed the control unit requests a small change of the speed of the air pump, and thereby also of the A/F ratio. The test adjusting means is then closed again whereby the mixture is shortly made leaner, and a new change of the pump speed is made guided by the sensed engine speed. This goes on until the engine speed variation is such as to correspond to a preferred state of operation.

Several different alternative embodiments of adjusting means are possible as is apparent from the description of embodiments. In addition, at least the second control circuit comprises a memory which stores information of the latest correct adjustment even when the engine is stopped. The engine will thereby probably start with a more correct adjustment than it would otherwise have had, provided that for example air pressure and fuel quality are generally the same as the last time the engine was in operation.

BRIEF DESCRIPTION OF THE DRAWINGS

The invention will be described in the following in the form of embodiments and with reference to the accompanying drawings in which the same reference numerals are used for corresponding parts in the different figures.

DETAILED DESCRIPTION OF THE PREFERRED EMBODIMENT

Figure 1:
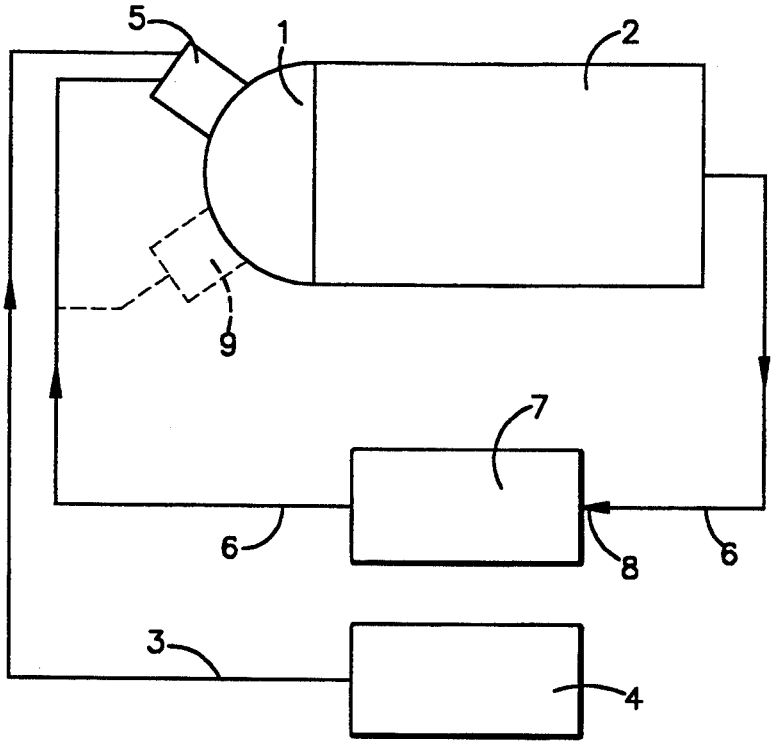
FIG. 1 is a diagrammatical illustration of a control system according to the invention.

In FIG. 1, a carburetor 1 is shown which is attached to an i. c. engine 2. A first control circuit 3 comprises a first control unit 4 and an adjusting means 5 actuating the function of the carburetor. The first control circuit 3 is used to correct the air/fuel graph in relation to the engine speed in order to obtain a generally constant A/F ratio at a varying engine speed. This can be seen in e.g. FIG. 4. A second control circuit 6 comprises a second control unit 7 which controls at least one adjusting means 5, 9. The adjusting means 9 is provided on the carburetor and actuates the function thereof. The second control unit 7 receives engine speed information 8, and the second control circuit 6 has an engine speed feed-back connection.

The second control unit utilizes for its operation both the speed of rotation and the first derivative thereof which is calculated. Briefly, the second control circuit 6 functions as follows. The second control unit 7 provides a slight and short actuation of an adjusting means 5 or 9. The A/F ratio is thereby changed, normally towards leaner mixture. The change of engine speed caused thereby is fed to the control unit which on the basis thereof orders an adjustment means 5 to be changed slightly and stepwise. A repeated slight and short actuation of an adjusting means 5 or 9 is carried out. The change of speed of rotation caused thereby is again fed to the control unit which on the basis thereof provides a small change of the adjusting means 5, and so on, until an appropriate adjustment of the adjusting means has been obtained. This will be apparent from the fact that the change of engine speed is such that no adjustment is required.

The second control circuit 6 is a closed, feed-back control system in which the result of a control step defines the next control step to be taken. The second control circuit can thereby provide correction for a plurality of disturbances that the engine might be exposed to. Such disturbances may be for instance variations of air pressure and temperature, fuel type and quality, and also defects of manufacture of the carburetor, such as varying tolerances.

Figure 4:
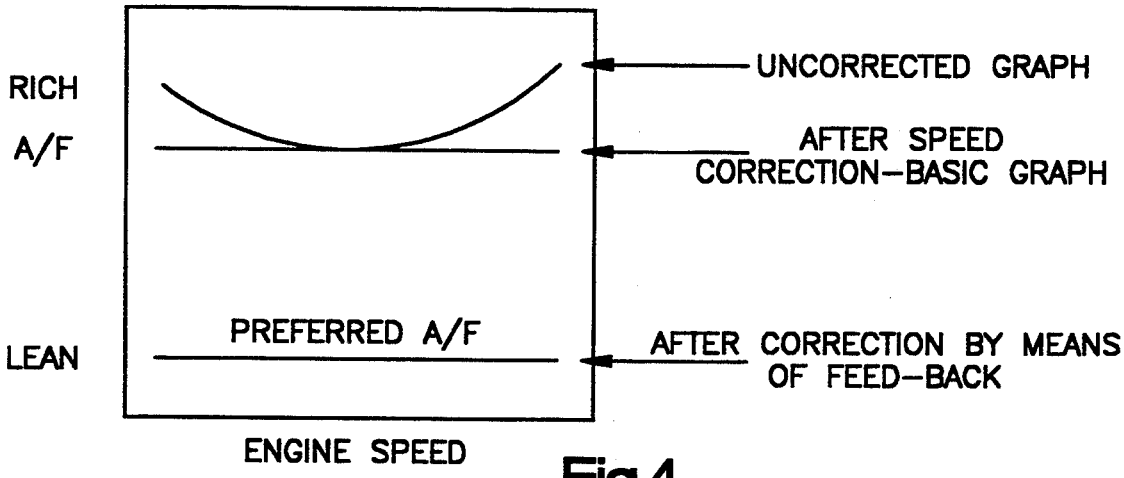
FIG. 4 illustrates the A/F ratio as a function of the engine speed.

The first control circuit 3, however, comprises an open control system. It can therefore only take care of deviations known when the engine type is made. As mentioned, it is used for correcting the A/F graph in accordance with engine speed. Data for performing this correction is available from previously made tests on the carburetor type in combination with the engine type. The data is stored in the first control unit 4. On the basis thereof the control circuit 3 performs the slightest possible adjustment of the uncorrected carburetor graph which is thereby corrected according to engine speed, (FIG. 4). In the illustrated case, the slight adjustment is made in that the upwardly directed ends of the A/F graph are bent downwardly to form a generally horizontal line. However, it is not preferred to downwardly move the horizontal A/F line as this would reduce the scope of control of the second control circuit 6 which due to its feed-back connection can perform adjustments based on actual disturbances.

The terms first and second control circuit are used here to distinguish two functional circuits, each of which comprise a control unit actuating at least one adjusting means. The two control units are normally integrated, e.g. on a circuit board, and are connected via conduits to the adjusting means, but wireless communication is also possible.

Figure 2:
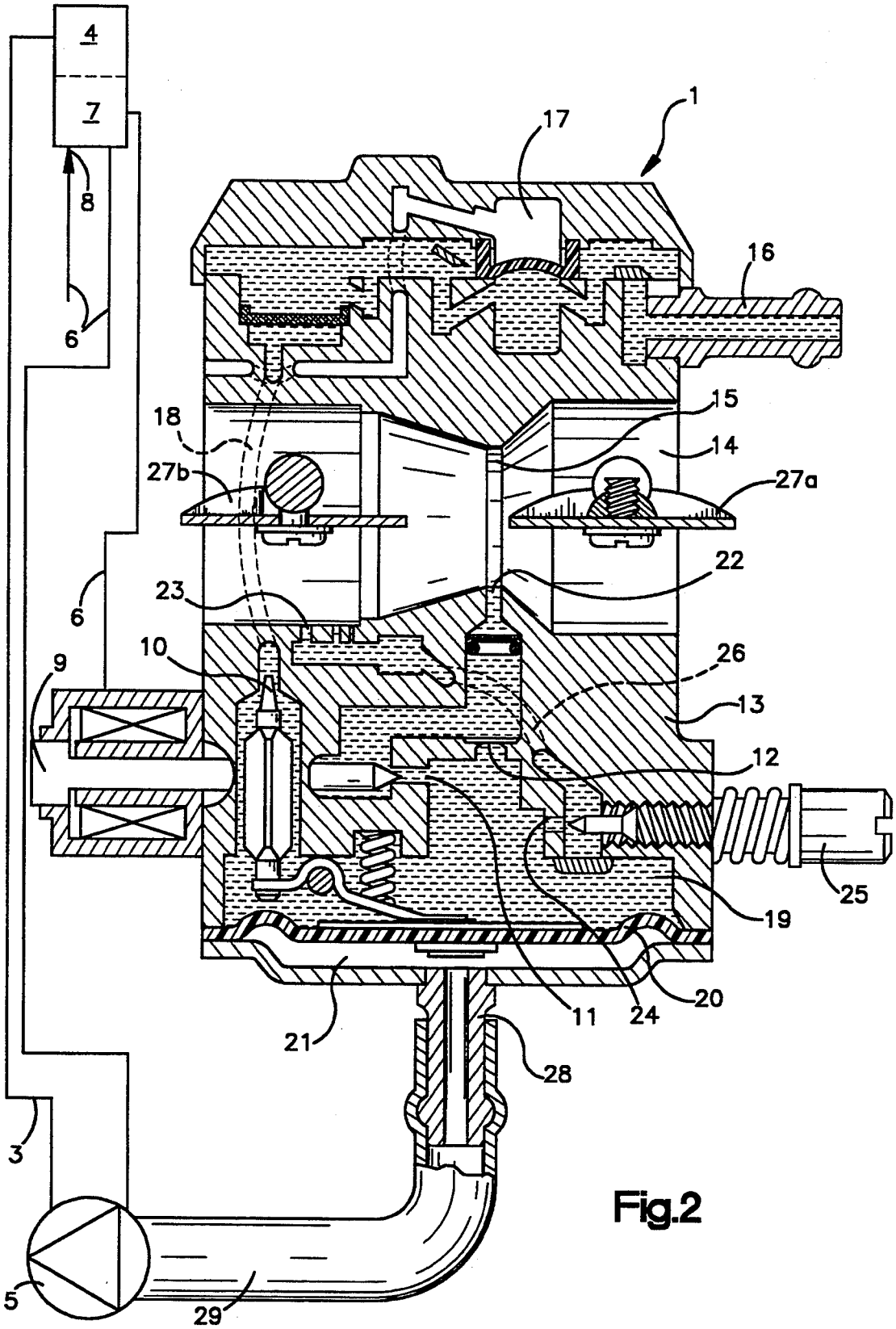
FIG. 2 is a sectional view of a carburetor adapted to the control system of FIG. 1.

FIG. 2 shows a section of a carburetor adapted to the control system according to the invention. The control system is shown diagrammatically. The carburetor comprises a housing 13 having a through-flow passage 14 with a venturi 15 at the central part thereof. A fuel nipple 16 provides a fuel inlet to the carburetor, and fuel is pumped via a passage 18 shown in a broken line to a fuel chamber 19 by means of a membrane pump 17 controlled by the pressure of the crankcase of the appurtenant engine. The fuel supply can also be provided by other means. The flow entering the fuel chamber 19 from the passage 18 is throttled by an inlet valve 10 which is controlled by a membrane 20 via a lever system. Because of this membrane the carburetor type is called membrane carburetor. An air chamber 21 is provided below the membrane 20.

A main nozzle 22 and one or more idling and low speed nozzles 23 are provided in the wall of the through-flow passage 14 adjacent to the venturi 15. The nozzle 23 is charged via a throttle 24 actuated by an idling needle set screw 25, and a passage 26 which is shown in broken lines. A choke valve **27*a* and a throttle valve 27*b* are provided in the through-flow passage 14**. These valves are shown in a full-gas position. The carburetor described this far has an entirely conventional design and the function thereof need therefore not be described in more detail.

In a conventional membrane carburetor, the air chamber 21 has direct communication with ambient air via an opening or a nipple 28. The carburetor according to the invention has instead a hose 29 leading from the nipple 28 to a pump 5 which is normally made as a vacuum pump and thus reduces the air pressure in the air chamber 21. The inlet valve 10 is thereby pushed upwards which increases the throttling of the fuel flow to the fuel chamber 19. This throttling loss reduces the pressure in the fuel chamber 19 and the injection of fuel through the nozzles 22 and 23 is thereby reduced which means that a leaner A/F ratio is obtained. The throttles 11 and 12 provided between the fuel chamber 19 and the main nozzle 22 are normally adjusted so as to deliver a rich mixture when the vacuum pump 5 is not actuated. The heavier the actuation of the vacuum pump 5, which means an increase of the speed of rotation thereof, or the like, the heavier the reduction of the pressure in the fuel chamber 19 and the leaner the A/F ratio. However, in principle it is possible to use other combinations, e.g. that the pump increases the air pressure in the air chamber 21, or it could perhaps both increase and reduce the pressure.

This reasoning relates to the shown membrane carburetor but is analogously applicable to a float carburetor. In such case the pump 5 provides a change of pressure in the float housing whereby the injected amount and consequently the A/F ratio are actuated.

A second difference in comparison with a conventional carburetor is that the supply of fuel to the main nozzle 22 is changed which is obtained by two throttles 11 and 12. The main portion of the flow passes the fixed throttle 12 and a minor, tributary flow passes the throttle 11. The adjusting means 9 has two positions, a front position in which its needle interrupts the flow through the throttle passage 11, and a rear position in which the passage is left open. The ajusting means 9 is a solenoid valve which is controlled by the control unit 7 to take its open or closed position. This is a simple, cheap, and reliable solution. In the control circuit 6 it is used as a test adjusting means. Adjustment of the carburetor characteristic is made periodically, and not continuously as in many other control systems. This means that a round of adjustment is started at even intervals in the second control circuit 6. The adjustment begins with closing of the test adjusting means 9 which interrupts the tributary flow through the throttle 11. This means that the flow of fuel through the main nozzle 22 decreases almost instantaneously. The adjustment is such that the reduction is small.

The reduction of the fuel flow through the main nozzle 22 results in a corresponding change of the speed of rotation of the engine. The magnitude of the variation of the speed of rotation depends on the accuracy of the amount of fuel, i.e. the A/F ratio, before the change took place. By analysing the variation in the control unit it can be established whether the fuel mixture should be made leaner, richer, or be maintained. This can be best seen in FIGS. 5 and 6. For example, if a leaner mixture should be preferred, the second control unit 7 orders an increased speed of the pump 5. This change is performed by a predetermined step.

It is important to note that the closing of the test adjusting means 9 is of short duration only and the variation is not directly noticeable to the operator of the engine. After this first change of the adjusting means to leaner mixture a new test is made by closing the test adjusting means 9 again and analysing the variation of the speed in the control unit 7. As a result thereof the mixture may be made still leaner, and a further test may indicate that no further adjustment is necessary which means that the setting is maintained for a predetermined time of operation until it is time to make a new test.

As mentioned previously, the control circuit 3 is used for adjusting the air/fuel ratio to the speed of rotation. Unlike the second control circuit 6 the first control circuit operates continuously. However, this does not mean that it is operating all the time but rather that it is in operation as often as is possible and appropriate. In a control system to which current is supplied from an engine lacking a battery, current is supplied from the ignition system. This supply of current is not quite continuous but consists of pulses. The first control unit 4 actuates the adjusting means 5 in such continuous manner that it does not cause any extra variation of the speed of rotation of the engine.

In the shown example, the first control unit 4 thus adds a speed correction whereby the air/fuel ratio will be generally constant throughout the whole range of the speed of rotation. This correction can be considered a basic correction. The second control unit 7 makes a correction with regard to other parameters wherein a test adjusting means 9 is used for temporarily providing a leaner mixture ratio. The speed information 8 received by the control unit 7 is used for analysis, and the speed or throttling of the vacuum pump is changed stepwise. This is repeated until the result is acceptable. A great variety of adjusting means can be used. Instead of a vacuum pump the inlet tube can be used as a suction source and the pressure can be controlled by means of a pulsed solenoid valve. Instead of controlling the reference pressure in the air chamber 21 one or two fuel nozzles can be controlled. Primarily, the test adjusting means could be supplemented with a throttle needle in the throttle 12, or at the position of the inlet valve 10. The needle could be controlled proportionally, for instance by an electric motor, and could take over the function of the pump 5 completely.

However, the needle could also take over the function of the test adjusting means 9. In such case the needle should be made such as to be able to perform a first step of movement substituting the test change provided by the adjusting means 9. This can be obtained, for example, by supplying a step pulse to the drive motor thereof, or by using a stepping motor. Correspondingly, it is possible to replace the test adjusting means 9 by changing the operation of the pump stepwise. Furthermore, it is possible to control an air dilution from an air nozzle instead of controlling a fuel nozzle. The air dilution can for example be controlled by a pulsed solenoid valve. The shown embodiment has simple and reliable components and provides for a rapid function.

Figure 3:
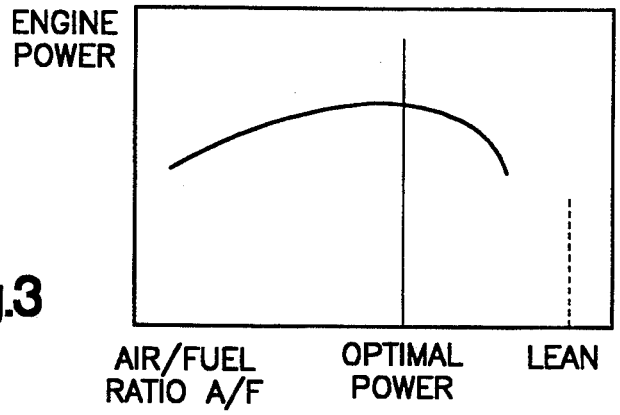
FIG. 3 is a diagram indicating the variation of the engine power with the air/fuel ratio.

In addition to the above description of the design and function of the control system it could be appropriate to take a somewhat closer look at the basis of the control. FIG. 3 illustrates the known feature of an i. c. engine that the power of the engine at a certain point of operation depends on the A/F ratio and is rapidly reduced when the A/F ratio is too great, i.e. when the mixture is too lean. A/F ratio approaches leaner mixture along the horizontal axis, and the position of A/F ratio at optimal power is marked. The second control unit 7 provides a short term increase of A/F ratio, which makes the mixture leaner, by closing the test adjusting means 9 a short period.

On the basis of the engine power graph the following conclusions can be drawn, provided the load of the engine is constant. If the temporary lean adjustment takes place at the position of optimal power it will hardly result in any change of speed at all. On the other hand, if the adjustment takes place at a position in which the initial mixture is rich, the power and also the speed of the engine will increase. However, if this should take place at a position of initially lean mixture the power and speed of the engine will decrease. On the basis of the change of speed it is thus possible to see on which side of the optimal power position the engine is operating. This description applies in an analogous manner also to various cases of partial load, i.e. other positions of the gas throttle. As a rule, it is preferred to operate at a point slightly to the leaner side of the point of optimal power since the amount of carbon dioxide as well as as the fuel consumption will be reduced thereby.

Figure 5:
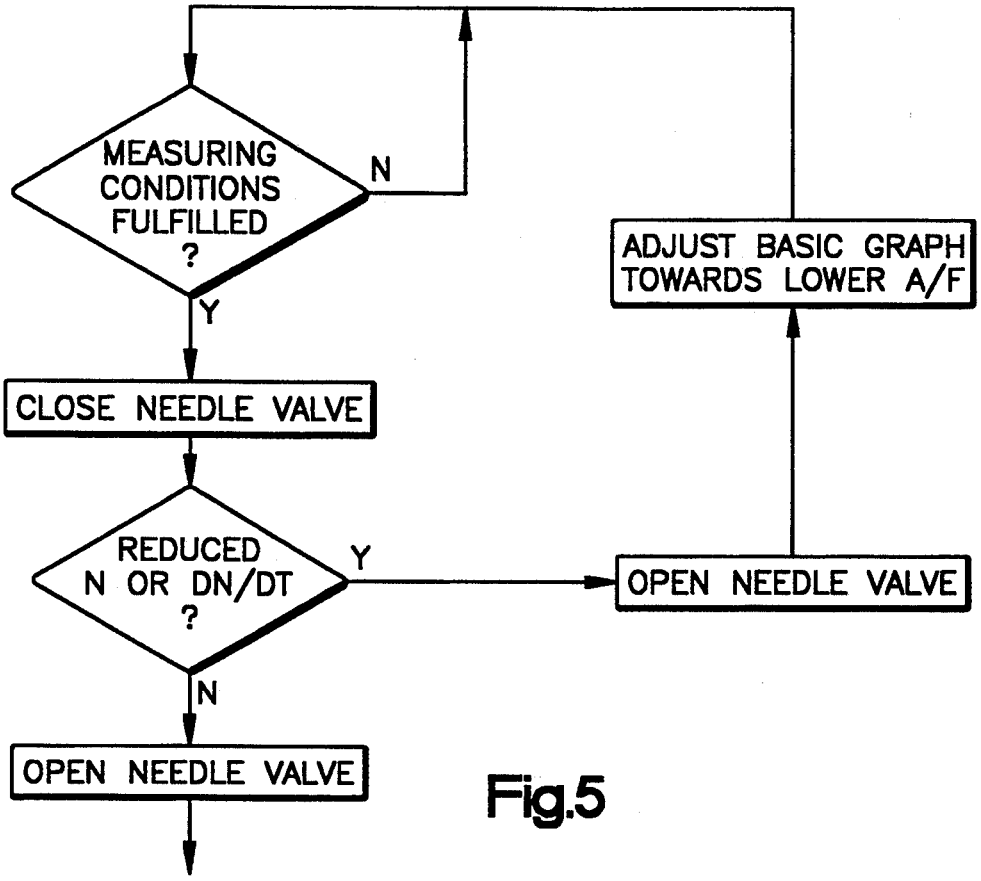
FIG. 5 is a block diagram illustrating how a correction towards a richer mixture is performed in the control system.
Figure 6:
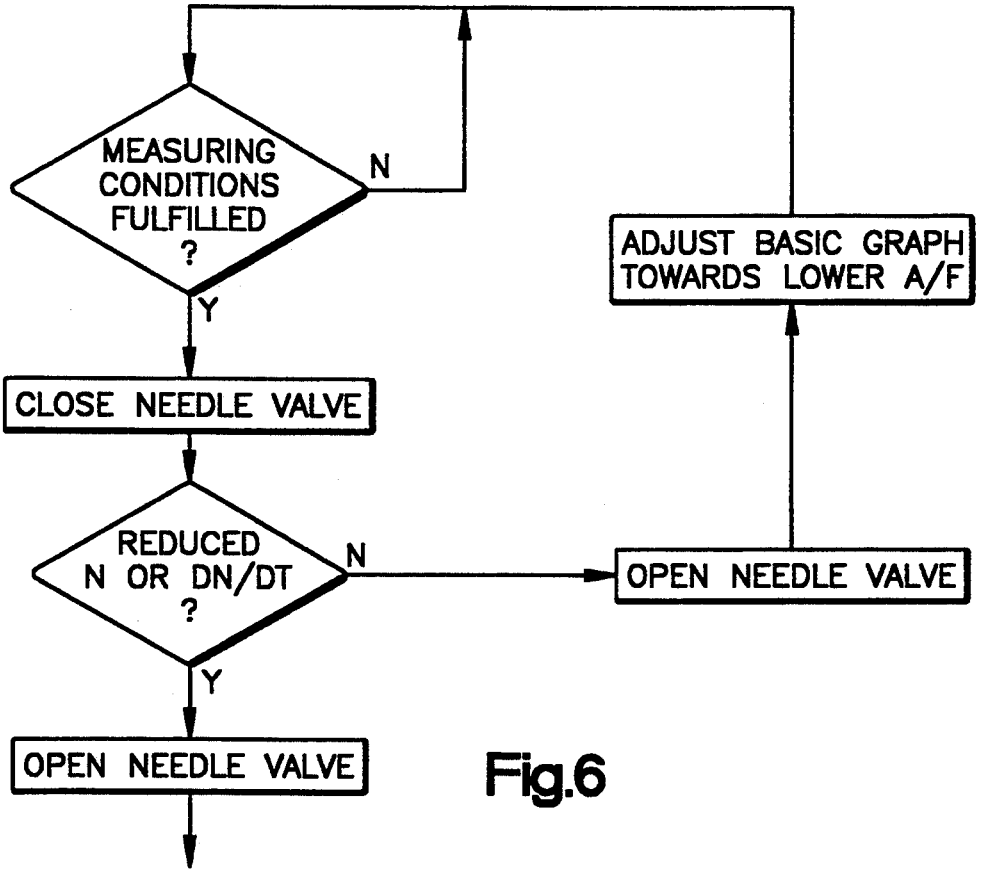
FIG. 6 is a block diagram illustrating how a correction towards a leaner mixture is performed in the control system.

FIGS. 5 and 6 illustrate the control provided by the second control unit 7. FIG. 5 shows a correction towards the rich side and FIG. 6 towards the lean side. In both cases it is first checked that the prerequisites of the measuring procedure are fulfilled, for example that the speed of rotation is within acceptable limits. If this is the case, the needle valve, i.e. the test adjusting means 9, is closed for a short period. If this results in a reduction of the speed or the derivative thereof, an adjustment of the basic graph is made towards lower A/F ratio, i.e. richer A/F ratio. However, if the speed or the speed derivative does not decrease but instead increases, an adjustment of the basic graph towards higher A/F ratio, i.e. leaner mixture, is made. The basic graph is the A/F graph at different speeds after speed correction.

Since a point of operation somewhat leaner than that of optimal power is preferred, the control criteria are selected such that this is obtained. This means that a certain minor reduction of the speed or the derivative thereof is allowed without altering the basic graph. With reference to FIGS. 3 and 5, this means that adjustment will take place from a lean initial position until the point of operation approaches the position of optimal power. In FIGS. 6 and 3, adjustment is made from a rich initial position up to and beyond the optimal power position. The control system could possibly also comprise control according to FIG. 6 only, since a return towards a rich basic adjustment will take place anyway, for example when the engine is stopped.

FIG. 4 shows how the A/F ratio is changed by the control system as a function of the engine speed. The diagram is drawn such that the mixture is rich at the top and lean at the bottom. The upper curved graph is the uncorrected graph of the carburetor. The curved form is not preferred and a generally constant A/F ratio at various speeds of rotation is instead preferable, i.e. a horizontal line in the diagram. As mentioned, the first control unit 4 performs a speed correction such that the ends of the uncorrected graph are bent downwardly. This correction is based on stored information about the carburetor and type of engine. After this speed correction, a speed corrected graph or basic graph is obtained. The bottom graph of the Figure shows the preferred A/F of the actual case. Due to the feed-back connection of the second control circuit the required correction is made for obtaining the preferred result.

We claim:

1. A method of controlling a carburetor of an internal combustion engine to automatically adjust an A/F ratio thereof to a preferred value, said method comprising the steps of:

(a) adjusting said A/F ratio to provide a modified relation of said A/F ratio to a speed of rotation of said engine with regard to a predetermined relation of said A/F ratio to said speed of rotation, said A/F ratio being generally continuously adjusted by an adjusting means, said adjusting means being actuated by a first control unit in response to a signal output of a first control circuit;

(b) periodically changing said A/F ratio to a different level for a short period of time, said A/F ratio being changed by said adjusting means, said adjusting means being actuated by a second control unit in response to a signal output of a second control circuit, wherein said second control unit receives a signal corresponding to said speed of rotation;

(c) measuring a change in said speed of rotation when said A/F ratio is changed to said different level;

(d) determining whether said A/F ratio is a leaner mixture or a richer mixture compared to said preferred value;

(e) adjusting said A/F ratio a predetermined step toward said preferred value by said adjusting means, said adjusting means being actuated by said second control unit in response to a signal output of said second control circuit;

(f) repeating steps (b) through (e) until said A/F ratio is substantially equal to said preferred value; and (g) repeating steps (b) through (f) after a predetermined period of time.

2. Method according to claim 1, wherein said modified relation of said A/F ratio to said speed of rotation is a generally constant level o said A/F ratio at varying speed of rotation.

3. Device for controlling a carburetor of an internal combustion engine to automatically adjust the A/F ratio thereof to a preferred value, said device comprising first and second control circuits and means for adjusting said A/F ratio, a first control unit of said first control circuit for actuating said adjusting means in response to a signal output of said first control circuit to generally continuously adjust said A/F ratio to provide a modified relation of said A/F ratio to a speed of rotation of said engine, and a second control unit of said second control circuit for actuating said adjusting means in response to a signal output of said second control circuit to periodically change said A/F ratio to a different level for a short period of time and adjust said A/F ratio a predetermined step toward said preferred value, wherein said second control unit receives a signal corresponding to said speed of rotation.

4. Device according to claim 3, wherein said adjusting means is proportionally actuated by said signal output of said first control circuit and said signal output of said second control circuit to adjust said A/F ratio.

5. Device according claim 3, wherein said second control circuit (6) comprises a memory means in which information of a last correct adjustment is stored even when said engine is not in operation.

6. Device according to claim 3 or 4, wherein said adjusting means comprises a fuel needle actuated by a solenoid valve to move between an open position allowing a tributary flow to a main nozzle (22) of said carburetor via a throttle (11), and a closed position interrupting said tributary flow to change said A/F ratio to a leaner mixture for said short period of time.

7. Device according to claim 6, wherein said adjusting means comprises a pump connected to an air chamber (21) of said carburetor to provide a change of air pressure in said air chamber, and an inlet valve (10) actuated by said change of air pressure to control the pressure in a fuel chamber and an amount of fuel injected via said main nozzle of said carburetor whereby the A/F ratio is adjusted, a fixed throttle (12) being provided to supply a main flow to said main nozzle (22).

8. Device according to claim 6, wherein said adjusting means (5) comprises a fuel needle which is continuously axially movable to control a flow to said main nozzle (22) and thereby adjust said A/F ratio.

* * * * *

UNITED STATES PATENT AND TRADEMARK OFFICE

CERTIFICATE OF CORRECTION

PATENT NO. : 5,345,912

DATED : September 13, 1994

INVENTOR(S) : Svensson et al.

It is certified that error appears in the above-identified patent and that said Letters Patent is hereby corrected as shown below:

Column 2, line 2, after "engine" insert --,-- (comma);

line 4, after "thereby" delete "," (comma); and

Column 8, line 29, (Claim 2, line 3), delete "o" and insert --of--.

Signed and Sealed this

Fourteenth Day of February, 1995

*Attest:*

*Attesting Officer*

BRUCE LEHMAN

*Commissioner of Patents and Trademarks*